US008162455B2

(12) United States Patent
Miyata et al.

(10) Patent No.: US 8,162,455 B2
(45) Date of Patent: Apr. 24, 2012

(54) DISCHARGE DEVICE

(75) Inventors: Takahiro Miyata, Chigasaki (JP); Masao Murata, Chigasaki (JP); Satoshi Shiba, Chigasaki (JP); Mitsuru Yahagi, Chigasaki (JP); Jyunpei Yuyama, Chigasaki (JP)

(73) Assignee: Ulvac, Inc., Chigasaki-shi (JP)

( * ) Notice: Subject to any disclaimer, the term of this patent is extended or adjusted under 35 U.S.C. 154(b) by 0 days.

(21) Appl. No.: 13/078,239

(22) Filed: Apr. 1, 2011

(65) Prior Publication Data

US 2011/0199442 A1 Aug. 18, 2011

Related U.S. Application Data

(63) Continuation of application No. PCT/JP2009/067337, filed on Oct. 5, 2009.

(30) Foreign Application Priority Data

Oct. 7, 2008 (JP) ..... 2008-260442

(51) Int. Cl.
*B41J 2/175* (2006.01)

(52) U.S. Cl. ..... 347/85; 347/86

(58) Field of Classification Search ..... None
See application file for complete search history.

(56) References Cited

U.S. PATENT DOCUMENTS

| | | | | |
|---|---|---|---|---|
| 4,044,923 | A * | 8/1977 | Gardner | 222/190 |
| 7,717,548 | B2 * | 5/2010 | Tatsumi et al. | 347/85 |
| 2008/0198207 | A1 * | 8/2008 | Katada | 347/85 |

FOREIGN PATENT DOCUMENTS

| | | | |
|---|---|---|---|
| JP | 6-320746 | | 11/1994 |
| JP | 2683187 | B2 | 11/1997 |
| JP | 3163864 | B2 | 5/2001 |
| JP | 2002-219815 | A1 | 8/2002 |
| JP | 2003-159813 | A1 | 6/2003 |
| JP | 3513979 | B2 | 3/2004 |
| JP | 2006-123562 | A1 | 5/2006 |
| JP | 2007-62189 | A1 | 3/2007 |

OTHER PUBLICATIONS

International Search Report for International Application No. PCT/JP2009/067337 dated Nov. 9, 2009.

* cited by examiner

*Primary Examiner* — Matthew Luu
*Assistant Examiner* — Erica Lin
(74) *Attorney, Agent, or Firm* — Kratz, Quintos & Hanson, LLP

(57) ABSTRACT

The back pressure of an ink tank is controlled. A porous body is arranged inside the ink tank, the lower end of the porous body contacts an ink, and the ink ascends inside the porous body due to a capillary force. The upper end of the porous body is not immersed in the ink, and a maximum ascending force acts upon the ink stored in the ink tank. Therefore, the ink does not leak from a discharge head located lower than the ink tank. Further, because the ink is accumulated under the porous body and the amount of the ink contacting the porous body is small, components of the ink are less susceptible to deterioration.

7 Claims, 2 Drawing Sheets

DISCHARGE DEVICE

This application is a continuation of International Application No. PCT/JP2009/067337, filed on Oct. 5, 2009, which claims priority to Japan Patent Application No. 2008-260442, filed on Oct. 7, 2008. The contents of the prior applications are herein incorporated by reference in their entireties.

BACKGROUND

The present invention relates to a liquid drop discharge device for printing by discharging a discharge liquid (ink).

In an ink jet discharge device for printing by discharging liquid drops through nozzles, a print head and an ink tank are ordinarily connected by a dedicated use flow path, so that the ink stored inside the ink tank is fed to the print head through this flow path.

The fed ink is pushed out as ink drops through a nozzle hole with a pressure wave generated by a pressure generating device (for instance, in an on-demand type ink jet head, an actuator (such as, a heater, a piezoelectric element or the like)) placed inside the print head.

At this time, in order to efficiently discharge the ink drops through the nozzle hole, the meniscus of the ink (the surface state of the ink) at a portion of the nozzle hole needs to be stably held when the print head is in no operation. In order to maintain the meniscus, a force that counters a force by which the ink drop spontaneously falls under gravitation must be given to the ink.

However, the above-mentioned on-demand type print head is equipped with a liquid drop ejecting mechanism, it is never provided with a mechanism for preventing the ink from leaking through the print head when the print head is in no operation. Therefore, a method in which a pressure (back pressure) is applied in order to prevent the leakage of the ink is used.

However, the minimum control range of the back pressure required in the ink jet discharge device is around about 10 mm $H_2O$ or less; and thus, a difference in pressure between an outside atmosphere and the back pressure is extremely small. For this reason, it is difficult in a system using a conventional vacuum pump or the like to control this pressure range with good precision.

As one of the conventional art techniques for providing the back pressure, there are numerous examples in which a network porous body is provided inside an ink tank (See JP Patent No. 2683187, JP Patent No. 3163864, JP Patent No. 3513979 and JPA 2007-62189).

According to this technique, a capillary force, which is generated by fine pores of the porous body when the ink is sucked into the porous body, is utilized as the back pressure to hold the ink. It is possible to control the capillary force based on dimensions, the material, the shapes of the fine pores, etc. In this method, however, there is a problem in that a component of the ink is adsorbed on the porous body because the back pressure control accuracy is low and a large amount of the ink is contained in the porous body.

As another method to provide the back pressure, there is an example in which such a porous body as mentioned above is not used (See, JPA 2006-123562). According to this reference, a movable lid, which is movable up and down, is provided at an interface portion between a gas and the liquid of the stored ink, and the ink is directly held by generating a negative pressure at this lid portion. However, in this method, a separate spring mechanism, which is to push up the movable lid, is necessary so as to hold the negative pressure, which may pose a limitation on the structure of the device.

SUMMARY OF THE INVENTION

The present invention has been accomplished to solve the above-mentioned problems, and is aimed at providing a technique which can control the back pressure inside an ink tank with high accuracy.

In order to solve the above-mentioned problems, the present invention is directed to a discharge device including a discharge head, an ink tank, and a valve device, wherein when the valve device is opened, the discharge head is connected with the ink tank; whereas, when the valve device is closed, the discharge head is shielded from the ink tank and wherein a suction member having a porous body is arranged inside the ink tank, and in a liquid-stored state that the ink is stored inside the ink tank, at least a part of the suction member contacts an inner wall face of the ink tank, and is held stationarily to the ink tank by a static friction force, and the ink ascends up to a midway portion of the porous body due to a capillary force.

The present invention is directed to the discharge device, wherein the discharge head is provided with a discharge opening at a position lower than the ink tank. When the valve device is opened, the ink inside the ink tank moves to the discharge head through the valve device and a height at which the ink ascends in the porous body becomes smaller as compared to a state in which the valve device is closed, so that a suction force is generated to pull the ink upwardly, and the ink does not leak through the discharge opening.

The present invention is directed to the discharge device, wherein when the amount of the ink inside the ink tank is constant, the suction member is stationary due to the static friction force; whereas, when the amount of the ink inside the ink tank is decreased by a predetermined amount or more, the suction force becomes greater than the static friction force, and the suction member moves downwardly.

The present invention is directed to the discharge device, wherein the ink tank is provided with an outside connection opening to connect an interior space of the ink tank with an outside atmosphere to which the discharge opening is exposed.

The back pressure inside the ink tank can be controlled in a minimum control pressure range of 1 mm $H_2O$. Because the back pressure is controlled at high accuracy, leakage of the ink through the discharge opening is prevented, and the meniscus is stabilized. Because the meniscus is stabilized, the discharged state of the liquid drops (such as, the discharged amount of the liquid drops through the discharge opening and accuracy in an impinged position) is stabilized. Since the amount of the ink contacting the porous body is small, the components of the ink are difficult to be changed in quality.

DETAILED DESCRIPTION OF THE INVENTION

Figure 1A:
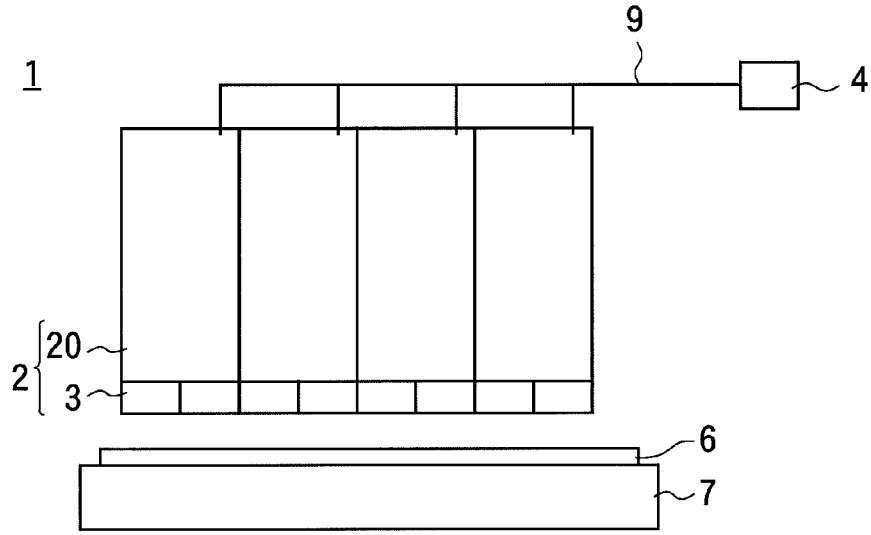
FIG. 1(*a*) is a side view of a printer apparatus, and FIG. 1(*b*) is a plan view of the printer.
Figure 1B:
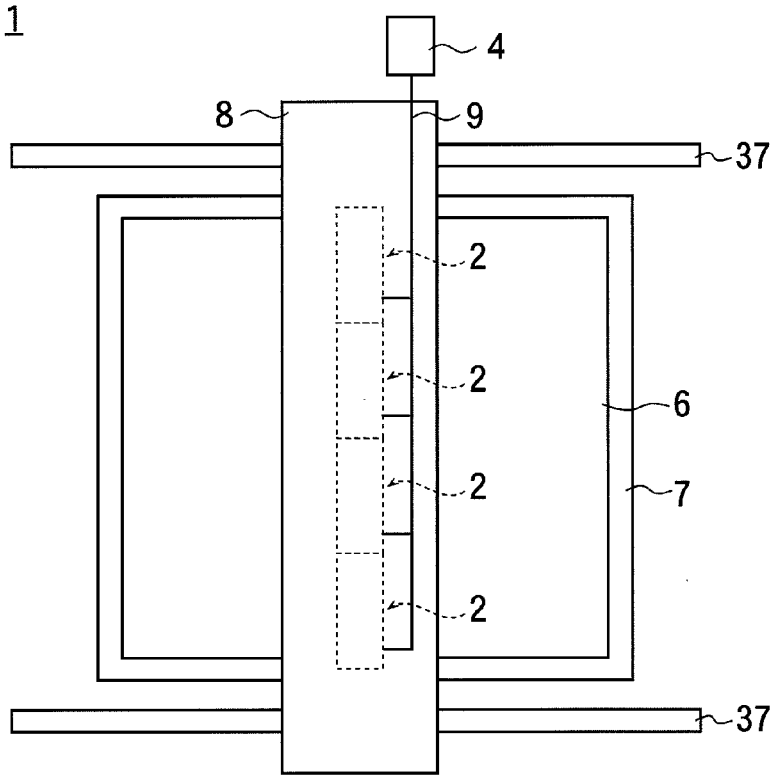

FIGS. 1(*a*) and (*b*) are a side view and a plane view of the printer. The printer 1 includes a table 7 and a movable arm 8 arranged above the table 7.

Rails 37 are extended along sides of the table 7, and the movable arm 8 is reciprocated in extending directions of the rails 37 by means of a moving unit (not shown). In FIG. 1(*a*), the rails 37, the movable arm 8 and a device to ride the movable arm 8 on the rails 37 are omitted.

The movable arm 8 is equipped with one or plural discharge devices 2. Each of the discharge devices 2 has at least one discharge head 3. The discharge head 3 is provided with a discharge opening (not shown), and the discharge openings of the discharge heads 3 are exposed at a bottom face of the movable arm 8.

The height from a front surface of the table 7 to the bottom face of the discharge head 3 is set larger than the thickness of a substrate 6 as an object to be treated so that the discharge heads 3 move together with the movable arm 8 above the table 7 without contacting the substrate 6 placed on the table 7.

Each discharge device 2 has a discharge unit 20, and the discharge head 3 is connected to the discharge unit 20. The number of the discharge heads 3 connected to one discharge unit 20 may be one or more. In this embodiment, the printer 1 has plural (four in this embodiment) discharge units 20, and plural (two in this embodiment) discharge heads 3 are connected to each discharge unit 20. In addition, the printer 1 may be equipped with one or more discharge units 20.

Figure 2:
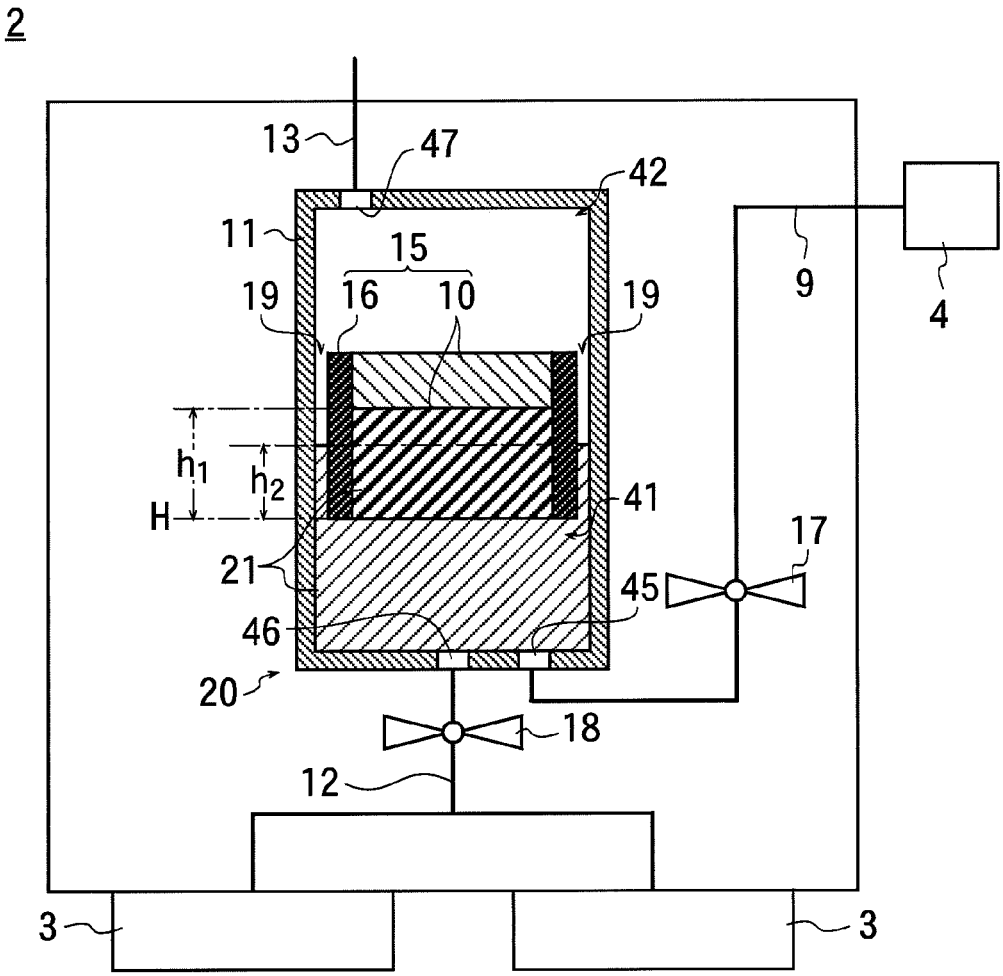
FIG. 2 is a sectional view illustrating one embodiment of the discharge device according to the present invention.

Each discharge unit 20 has the same structure, and one discharge unit 20 is shown and explained in a schematically sectional view of the discharge device of FIG. 2, which replaces explanation of the plural discharge units 20. The discharge unit 20 has an ink tank 11.

An outside connection opening 47 is provided in a ceiling of the ink tank 11, and an inflow opening 45 and an outflow opening 46 are provided in a bottom face, respectively. One ends of flow paths 9, 12, 13 (such as, pipes) are connected to the outside connection opening 47, the inflow opening 45, and the outflow opening 46, respectively.

The other end of the flow path 13, which is connected to the outside connection opening 47, is connected to an outside atmosphere (the open air atmosphere in this embodiment) of the discharge device 2, and as later discussed, the interior space of the ink tank 11 is connected to the outside atmosphere at least when the ink is to be stored in the ink tank 11 and during when the ink is to be discharged through the discharge head 3.

A main tank 4 is provided outside the discharge device 2.

The other end of the flow path 9, which is connected to the inflow opening 45, is connected to the main tank 4; the other end of the flow path 12, which is connected to the outflow opening 46, is connected to the discharge head 3; and cocks (valve devices) 17, 18 are provided on ways of the flow paths 9 and 12.

The ink is stored in the main tank 4; and when the cock 17 between the main tank 4 and the inflow opening 45 is opened, the ink tank 11 is connected to the main tank 4, and the ink inside the main tank 4 is introduced into the ink tank 11 through the flow path 9, the cock 17 and the inflow opening 45. On the other hand, when the cock 17 is closed, the introduction of the ink is stopped. A reference numeral 21 in FIG. 2 denotes the ink that is introduced and stored inside the ink tank 11.

Meanwhile, when the cock 18 between the discharge head 3 and the outflow opening 46 is opened, the ink 21 inside the ink tank 11 is fed into the discharge head 3 through the outflow opening 46, the cock 18 and the flow path 12; whereas, when the cock 18 is closed, the ink tank 11 is shielded from the discharge head 3, and the feeding of the ink 21 is stopped.

A suction member 15 is arranged inside the ink tank 11, and the suction member 15 includes a porous body 10 shaped in a columnar form, and a ring-shaped sealing member 16 covering the lateral face of the porous body 10, the sealing member 16 being held stationarily to the porous body 10.

Both bottom faces of the porous body 10 are exposed, one of the exposed both bottom faces is directed upwardly, and the other is directed downwardly. Because the inflow opening 45 is provided in the bottom face of the ink tank 11, when the ink 21 is fed from the main tank 4 to the ink tank 11 and stored inside the ink tank 11, a lower portion of the porous body 10 including the bottom face is in contact with the ink 21.

The porous body 10 is made of a spongy resin, a fibrous metal, a sintered body (such as, a ceramics in which pores are formed), an unwoven cloth or the like, for example, and its wettability to the ink 21 is made high (contact angle $\theta<45°$).

The suction member 15 and the internal space of the ink tank 11 are columnar, and their sectional shapes in a horizontal plane are the same. The suction member 15 is made slightly smaller than the internal space of the ink tank 11; and a gap 19 is formed between the lateral face of the suction member 15 and the inner wall face of the ink tank 11.

Further, the wettability to the ink 21 of the lateral face of the suction member 15 (the sealing member 16 in this embodiment) and the inner wall face of the ink tank 11 are also made high; and the gap 19 between the lateral face of the suction member 15 and the inner wall face of the ink tank 11 is set so narrow that the ink 21 may ascend due to a capillary force. Therefore, the ink 21 stored in the ink tank 11 can be soaked up into the interior of the porous body 10 and the gap 19 between the suction member 15 and the inner wall face of the ink tank 11 by the capillary force.

The ascending height of the ink 21 due to the capillary force (the height from the liquid surface H which the ascending portion of the ink 21 due to the capillary force is excluded, a water head difference h) can be calculated by a theoretical formula (1) of the capillary force.

$$h=2T\cos\theta/\rho gr \qquad \text{Theoretical formula (1):}$$

In the above theoretical formula (1), h is the water head difference (m), T is the surface tension (N/m) of the ink, $\theta$ is the contact angle of the ink to the porous body 10, $\rho$ is the density of the ink (kg/m$^3$), g is the gravitational acceleration (m/s$^2$), and r is the radius (m) of a capillary tube.

A reference numeral $h_1$ in FIG. 2 denotes a water head difference inside the porous body 10, and a reference numeral $h_2$ in the same FIG. 2 denotes the water head difference of the gap 19.

A part of the lateral face of the suction member 15 contacts the inner wall face of the ink tank 11, so that the porous body 10 is held stationarily to the ink tank 11 by the static friction force. The length of the suction member 15 (the distance between both the bottom faces of the porous body 10) is set shorter than the height from the bottom to the ceiling of the tank 11. Even after the water head differences $h_1$, $h_2$ reach the theoretical values determined by the above-discussed theoretical formula (1), the ink 21 is continuously fed; and when the pressure of the ink 21 exceeds the total of the static friction force and the weight of the suction member 15, the suction member 15 is pushed up.

The suction member 15 is surrounded by the inner wall face of the ink tank 11, the suction member 15 is supported by the inner wall face of the ink tank 11, and ascends, while the lower end is kept directed downwardly and in contact with the ink 21. The lower end of the porous body 10 is spaced from the bottom face of the ink tank 11; and the ink 21 is stored in a liquid-storing space 41 between the lower end of the porous body 10 and the bottom face of the ink tank 11.

After a predetermined amount of the ink 21 is stored in the liquid-storing space 41 and before the upper end of the porous body 10 reaches and contacts the ceiling of the ink tank 11, the cock 17 is switched from the opened state to the closed state, the main tank 4 is shielded from the ink tank 11, and the feeding of the ink from the main tank 4 to the ink tank 11 is stopped. The ascending of the suction member 15 is stopped, and it is held stationarily to the ink tank 11 by the static friction force.

As discussed above, the entire lower end of the porous body 10 is in close contact with the ink 21 and furthermore, the gap 19 between the suction member and the inner wall face of the ink tank 11 is set so narrow that the capillary force may act, so that the ascending force is applied to the entire portion of the liquid surface H of the ink 21 in the liquid-storing space 41 by the capillary force.

The length of the porous body 10 is set such that the height from the liquid surface H to the upper end of the porous body 10 is greater than the theoretical values of the water head differences $h_1$, $h_2$, so that the ink 21 does not reach the upper end of the porous body 10, which keeps it in a dried state. Therefore, the maximum capillary force always acts for the ink 21 in the liquid storing space 41.

Figure 3:
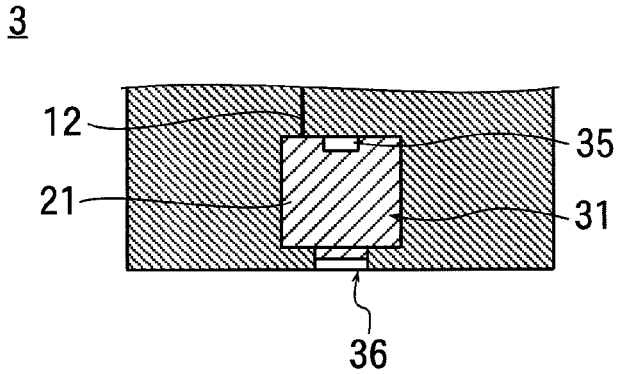
FIG. 3 is a sectional view illustrating one embodiment of a discharge head.

When the ink 21 is to be discharged, the cock 17 is closed to shield the ink tank 11 from the main tank 4, and the cock 18 is opened to connect the ink tank 11 with the discharge heads 3. FIG. 3 is an enlarged sectional view of a part of the discharge head 3, and the discharge head 3 includes an ink chamber 31 and a discharge opening 36 connected to the ink chamber 31, and the flow path 12, which connects the discharge head 3 to the ink tank 11, is connected to the ink chamber 31 in the discharge head 3. The ink, which is fed from the ink tank 11 to the discharge head 3, is fed to the ink chamber 31, and is exposed to the outside atmosphere of the discharge head 3 through the discharge opening 36.

The discharge opening 36 is positioned lower than the ink tank 11, and connected to the same atmosphere (the open air atmosphere) as that to which the outside connection opening 47 is connected. The liquid surface H inside the ink tank 11 is located higher than the surface of the ink 21 exposed inside the discharge opening 36, and no bubble is contained in the ink 21. Therefore, the ink 21 inside the ink chamber 31, the liquid-storing space 41 and the porous body 10 is pulled downwardly by the weight of the ink 21 under the liquid surface, so that the water head differences $h_1$, $h_2$ decrease beyond the theoretical values.

The wettability to the ink 21 of the porous body 10, the sealing member 16 and the inner wall face of the ink tank 11 are set high such that when the ink tank 11 is connected with the discharge head 3, and the wettability to the ink 21 is set high so as to prevent the water head difference $h_1$, $h_2$ being zero. When the descending force and the ascending force for the ink 21 are in balance, the decrease in the water head differences $h_1$, $h_2$ stops. Therefore, pull-up forces, which are differences between the theoretical value and actual values of the water head differences $h_1$, $h_2$, are applied to the ink 21.

Meanwhile, if there is a fear that the ink 21 leaks out from the discharge opening 36 during when the water head differences $h_1$, $h_2$ decrease, the head connecting state is turned on after the discharge device 2 is placed at an evacuation site outside a substrate 6. After the decrease in the water head differences $h_1$, $h_2$ stops and the ink 21 from the discharge opening 36 does not leak, the discharge device 2 is located above the substrate 6.

An actuator 35 (such as, a heater, a piezoelectric element or the like) is provided in the ink chamber 31. When the actuator 35 is heated or deformed by applying electric current therethrough in order to apply a pressing force to the ink 21 inside the ink chamber 31, the ink 21 is discharged through the discharge opening 36, and lands on the substrate 6.

Since the outflow opening 46 is positioned lower than the lower end of the porous body 10 (the bottom face of the ink tank 11 in this embodiment), when the liquid amount in the ink chamber 31 descends as the ink 21 is discharged through the discharge opening 36, the ink 21 is refilled into the ink chamber 31 from the ink tank 11.

At this time, because the ink is not refilled into the ink tank 11 from the main tank 4, the liquid surface H of the ink 21 in the liquid-storing space 41 descends, and a simultaneous descending force acts upon the ink 21 sucked in the porous body 10 by the capillary force.

When the liquid surface H descends, the capillary force serving to hold the ink 21 becomes larger, and when the capillary force exceeds the static friction force between the suction member 15 and the ink tank 11, the suction member 15 moves downwardly. Therefore, even when the ink is not refilled, the suction member 15 moves downwardly, and the state in which the lower end of the suction member 15 is in contact with the liquid surface H of the ink 21 is maintained.

When the liquid surface H descends, the difference between the surfaces of the discharge liquid 21 inside the discharge opening 36 becomes smaller, so that the force by which the ink 21 is pulled downwardly decreases. On the other hand, the water head differences $h_1$, $h_2$ increase, and the raising force based on the capillary force decreases, so that the descending force of the ink 21 is in balance with the ascending force. Thus, the height of the surface (meniscus) of the ink 21 inside the discharge opening 36 does not change.

When the suction member 15 descends and before the lower end of the porous body 10 reaches the outflow opening 46 or the inflow opening 45, the cock 18 is turned to a close state to shield the discharge head 3 from the ink tank 11, and the cock 17 is turned to an open state to refill the ink into the ink tank 11 from the main tank 4. Since the inflow opening 45 is located under the porous body 10, at least the upper end of the porous body 10 is kept dry without being wetted with the ink 21.

The inflow opening 45 may be located higher than the lower end of the porous body 10, so long as it is located lower than the upper end of the porous body 10. However, when the lateral face of the porous body 10 is covered with the sealing member 16, since the gap between the sealing member 16 and the inner wall face of the ink tank 11 is narrow, the ink 21 is not normally introduced if the inflow opening 45 is opposed to the sealing member 16. For this reason, it is desirable that the inflow opening 45 is located under the lower end of the porous body 10.

As discussed above, although the case where the lateral face of the porous body 10 is covered with the sealing member 16 has been explained, the present invention is not limited thereto. The lateral face of the porous body 10 may be exposed. However, when the suction member 15 moves up and down, it is feared that the porous body 10 is damaged by the friction, if the lateral face of the porous body 10 is exposed. Thus, it is desirable to protect the lateral face of the porous body 10 with the sealing member 16.

The porous body 10 to be used in the present invention has a spongy structure having a network structure in which fine pores communicate in random directions. Although its material is not particularly limited, it essentially has a resistance that it is not dissolved in the ink 21 or it is not chemically changed by contacting the ink 21. For example, an organic resin material (such as, a polyolefin resin or the like) can be recited.

One example of the requirements for the porous body 10 being described, when the bore (radius) of the ink tank 11 is 10 mm and the storing volume for the ink is 15 ml, the average bore (radius) of the pores is 63 μm, the average porosity is 44.8%, and the height of the member is 10 mm.

It is to be noted that based on the above one example as a standard, when the sectional area of the ink tank 11 is changed to n times, the average porosity has only to be made 1/n time. Meanwhile, if the storing volume for the ink is similarly changed to n times, the average porosity has only to be made n times. It is to be noted that the requirements for the porous body 10 can be calculated based on the above-discussed theoretical formula (1) of the capillary force.

The material of the porous body 10 is not limited to a resin, and a metal such as SUS (stainless steel) or the like can be used, so long as it has resistance against the ink 21. In this case, although a contact angle of the ink 21 to the porous body 10 may fall outside the above requirements, similar effects as the above discussed requirements can be exhibited by surface-treating of the porous body 10.

The ink 21 to be used in the present invention is not particularly limited, and besides a colored ink 21 which is added a coloring agent such as a pigment, a dye or the like, inks in which a material for an oriented film, a resin material, a material for a color filter, spacer particles or the like is dispersed or dissolved can be used.

The sealing member 16 is not particularly limited, so long as it is not dissolved in the ink 21 and it does not chemically change when coming in contact with the ink 21. In particular, a solvent-resistant resin (such as, a silicone resin, a fluorine resin, a polyolefin resin or the like) can be used.

As discussed above, the case where the suction member 15 is held stationarily to the ink tank 11 by the static friction force has been explained; however, the invention is not limited thereto. It may be that the entire lateral face of the suction member 15 is closely contacted with the lateral face of the ink tank 11 or the suction member 15 is mechanically fixed to the ink tank 11 by means of a fixing member, an adhesive or the like. In this case, since the suction member 15 does not move up or down even when the liquid surface H goes up and down, an appropriate amount of the ink 21 is successively refilled from the main tank 4.

What is claimed is:

1. A discharge device, comprising:

a discharge head;

an ink tank; and a valve device between said discharge head and said ink tank, wherein when the valve device is opened, the discharge head is connected with the ink tank, whereas when the valve device is closed, the discharge head is shielded from the ink tank, wherein a suction member having a porous body is arranged inside the ink tank, and wherein in a liquid-stored state that the ink is stored inside the ink tank, at least a part of the suction member contacts an inner wall face of the ink tank, the suction member is held stationarily to the ink tank by a static friction force, and the ink ascends up to a midway portion of the porous body due to a capillary force.

2. The discharge device according to claim 1, wherein the discharge head includes a discharge opening at a position lower than the ink tank, and wherein when the valve device is opened, the ink inside the ink tank moves to the discharge head through the valve device, and a height at which the ink ascends in the porous body becomes smaller as compared with a state in which the valve device is closed, so that a suction force is generated to pull the ink upwardly, and the ink does not leak through the discharge opening.

3. The discharge device according to claim 2, wherein when the amount of the ink inside the ink tank is constant, the suction member is stationary due to the static friction force, whereas when the amount of the ink inside ink tank is decreased by a predetermined amount or more, the suction force becomes greater than the static friction force, and the suction member moves downwardly.

4. The discharge device according to claim 1, wherein the ink tank is provided with an outside connection opening to connect an interior space of the ink tank with an outside atmosphere to which the discharge opening is exposed.

5. The discharge device according to claim 2, wherein the ink tank is provided with an outside connection opening to connect an interior space of the ink tank with an outside atmosphere to which the discharge opening is exposed.

6. The discharge device according to claim 3, wherein the ink tank is provided with an outside connection opening to connect an interior space of the ink tank with an outside atmosphere to which the discharge opening is exposed.

7. The discharge device according to claim 1, wherein the lateral faces of the porous body of the suction member are covered by a member.

* * * * *